US009059494B2

(12) United States Patent
Ding et al.

(10) Patent No.: US 9,059,494 B2
(45) Date of Patent: Jun. 16, 2015

(54) MARCHAND BALUN STRUCTURE AND DESIGN METHOD

(71) Applicant: International Business Machines Corporation, Armonk, NY (US)

(72) Inventors: Hanyi Ding, Colchester, VT (US); Yan Ding, Essex Junction, VT (US)

(73) Assignee: International Business Machines Corporation, Armonk, NY (US)

( * ) Notice: Subject to any disclaimer, the term of this patent is extended or adjusted under 35 U.S.C. 154(b) by 337 days.

(21) Appl. No.: 13/744,761

(22) Filed: Jan. 18, 2013

(65) Prior Publication Data

US 2014/0203885 A1 Jul. 24, 2014

(51) Int. Cl.
*H01P 5/10* (2006.01)
*H01F 41/02* (2006.01)

(52) U.S. Cl.
CPC *H01P 5/10* (2013.01); *H01F 41/02* (2013.01); *Y10T 29/49073* (2015.01)

(58) Field of Classification Search
CPC ..... H01P 5/10; H01F 17/0013; H01F 41/02
USPC ..... 333/25, 26; 343/700 MS
See application file for complete search history.

(56) References Cited

U.S. PATENT DOCUMENTS 4,825,220 A * 4/1989 Edward et al. ..... 343/795
5,025,232 A * 6/1991 Pavio ..... 333/26
5,497,137 A * 3/1996 Fujiki ..... 336/200
6,483,415 B1 * 11/2002 Tang ..... 336/200
7,215,218 B2 5/2007 Burns et al.
7,250,828 B2 7/2007 Erb
7,528,676 B2 5/2009 Kearns et al.
7,633,353 B2 * 12/2009 Okabe ..... 333/26
7,772,941 B2 8/2010 Yeung et al.
7,936,234 B2 5/2011 Wu et al.
8,502,620 B2 * 8/2013 Lu et al. ..... 333/25
2009/0140823 A1 6/2009 Lee et al.
2010/0026412 A1 2/2010 Kirkeby
2010/0045400 A1 2/2010 Wu et al.
2010/0315175 A1 12/2010 Ono et al.
2011/0102096 A1 5/2011 Jeong et al.

OTHER PUBLICATIONS

Kikel, Statutory Invention Registration No. US H1959 H, "Single Balanced to Dual Unbalanced Transformer", May 1, 2001, 10 pages.

* cited by examiner

*Primary Examiner* — Dean Takaoka
*Assistant Examiner* — Alan Wong
(74) *Attorney, Agent, or Firm* — David Cain; Hoffman Warnick LLC

(57) ABSTRACT

Aspects of the invention provide for a Marchand balun structure and a related design method. In one embodiment, a marchand balun structure includes: a first trace for an unbalanced port on a first metal layer, the first trace comprising: an unbalanced line including a first width for a first half and a second width for a second half, wherein the second width can be different from the first width; a pair of traces for balanced ports on a second metal layer, the pair of traces comprising: a pair of balanced lines; and a ground plane on a third metal layer, the ground plane comprising: a pair of openings directly under the pair of traces for balanced ports, wherein a center of the unbalanced line of the first trace is offset from a center of the pair of balanced lines of the pair of traces.

20 Claims, 7 Drawing Sheets

MARCHAND BALUN STRUCTURE AND DESIGN METHOD

FIELD OF THE INVENTION

The disclosure relates generally to baluns, and more particularly, to a Marchand balun structure and a related design method.

BACKGROUND

A balun is a type of transforming device that acts as an adaptor between devices that are configured for balanced, differential lines and devices that are configured for unbalanced, single-ended lines. As shown in FIG. 1A, a balun 10 receives an unbalanced, single-ended signal on line 12 with respect to ground and converts it into a balanced, differential signal on lines 14.

In FIG. 1B, baluns 10A, 10B are provided between a vector network analyzer (VNA) 16 and a device 18, such as a differential amplifier. VNA 16 is configured for unbalanced, single-ended lines, while device 18 is configured for balanced, differential lines. The first balun 10A converts the single-ended, unbalanced line from VNA 16 into balanced, differential lines for device 18 and the second balun 10B converts the balanced, differential lines from device 18 into a single-ended, unbalanced line for VNA 16.

The Marchand balun is one of the most commonly used baluns with a broad bandwidth. A standard Marchand balun can reach a bandwidth of approximately 80% to 100% of the center operating frequency.

BRIEF SUMMARY

Aspects of the invention provide a Marchand balun structure and a related design method. In one embodiment, a Marchand balun structure includes: a first trace for an unbalanced port on a first metal layer, the first trace comprising: an unbalanced line including a first width for a first half and a second width for a second half, wherein the second width can be different from the first width; a pair of traces for balanced ports on a second metal layer, the pair of traces comprising: a pair of balanced lines; and a ground plane on a third metal layer, the ground plane comprising: a pair of openings directly under the pair of traces for balanced ports, wherein a center of the unbalanced line of the first trace is offset from a center of the pair of balanced lines of the pair of traces.

A first aspect of the disclosure provides a Marchand balun structure comprising: a first trace for an unbalanced port on a first metal layer, the first trace comprising: an unbalanced line including a first width for a first half and a second width for a second half, wherein the second width is different from the first width; a pair of traces for balanced ports on a second metal layer, the pair of traces comprising: a pair of balanced lines; and a ground plane on a third metal layer, the ground plane comprising: a pair of openings directly under the pair of traces for balanced ports, wherein a center of the unbalanced line of the first trace is offset from a center of the pair of balanced lines of the pair of traces.

A second aspect of the disclosure provides a method of designing a Marchand balun structure, comprising: providing a first trace for an unbalanced port on a first metal layer, the first trace comprising: an unbalanced line including a first width for a first half and a second width for a second half, wherein the second width is different from the second width; providing a pair of traces for balanced ports on a second metal layer, the pair of traces comprising: a pair of balanced lines; and providing a grounding plane on a third metal layer, the ground plane comprising: a pair of openings directly under the pair of traces for balanced ports, wherein a center of the unbalanced line of the first trace is offset from a center of the pair of balanced lines of the pair of traces.

BRIEF DESCRIPTION OF THE DRAWINGS

The above and other aspects, features and advantages of the disclosure will be better understood by reading the following more particular description of the disclosure in conjunction with the accompanying drawings.

Figure 1B:
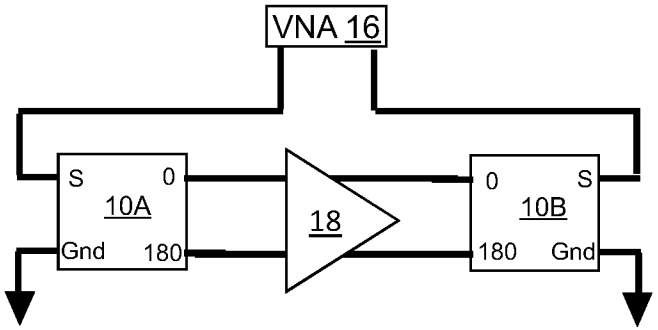
FIG. 1B shows a block diagram of usage of conventional baluns.

The drawings are not necessarily to scale. The drawings are merely schematic representations, not intended to portray specific parameters of the disclosure. The drawings are intended to depict only typical embodiments of the disclosure, and therefore should not be considered as limiting the scope of the disclosure. In the drawings, like numbering represents like elements.

DETAILED DESCRIPTION

The disclosure relates generally to baluns, and more particularly, to a Marchand balun structure, and a related design method.

As mentioned above, a balun is a type of transforming device that acts as an adaptor between devices that are configured for balanced, differential lines and devices that are configured for unbalanced, single-ended lines. As shown in FIG. 1A, a balun 10 receives an unbalanced, single-ended signal on line 12 with respect to ground and converts it into a balanced, differential signal on lines 14.

Figure 1A:
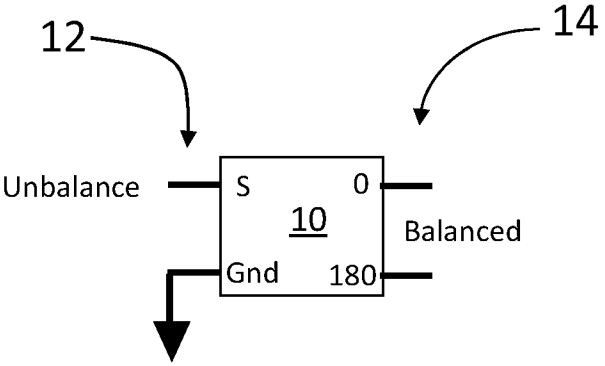
FIG. 1A shows a block diagram of a conventional balun.

In FIG. 1B, baluns 10A, 10B are provided between a vector network analyzer (VNA) 16 and a device 18, such as a differential amplifier. VNA 16 is configured for unbalanced, single-ended lines, while device 18 is configured for balanced, differential lines. The first balun 10A converts the single-ended, unbalanced line from VNA 16 into balanced, differential lines for device 18 and the second balun 10B converts the balanced, differential lines from device 18 into a single-ended, unbalanced line for VNA 16.

The Marchand balun is one of the most common used baluns with a broad bandwidth. A standard Marchand balun can reach a bandwidth of approximately 80% to 100% of the center operating frequency.

Prior art approaches exist to increase the bandwidth of Marchand baluns to greater than 100% of the center operating frequency. However, these approaches are limited. For example, some approaches are not available for generic printed circuit board (PCB) processes, since they require spacing beyond PCB process limits. Further, these approaches require more layout space, and/or blind vias with thin dielectric layers, which can be expensive or hard to realize. It is desirable to have a Marchand balun structure and design method that can reach a broader bandwidth, without these limitations.

Aspects of the invention provide a Marchand balun structure and a related method. In one embodiment, a Marchand balun structure includes: a first trace for an unbalanced port on a first metal layer, the first trace comprising: an unbalanced line including a first width for a first half and a second width for a second half, wherein the second width can be different from the first width; a pair of traces for balanced ports on a second metal layer, the pair of traces comprising: a pair of balanced lines; and a ground plane on a third metal layer, the ground plane comprising: a pair of openings directly under the pair of traces for balanced ports, wherein a center of the unbalanced line of the first trace is offset from a center of the pair of balanced lines of the pair of traces.

Figure 2:
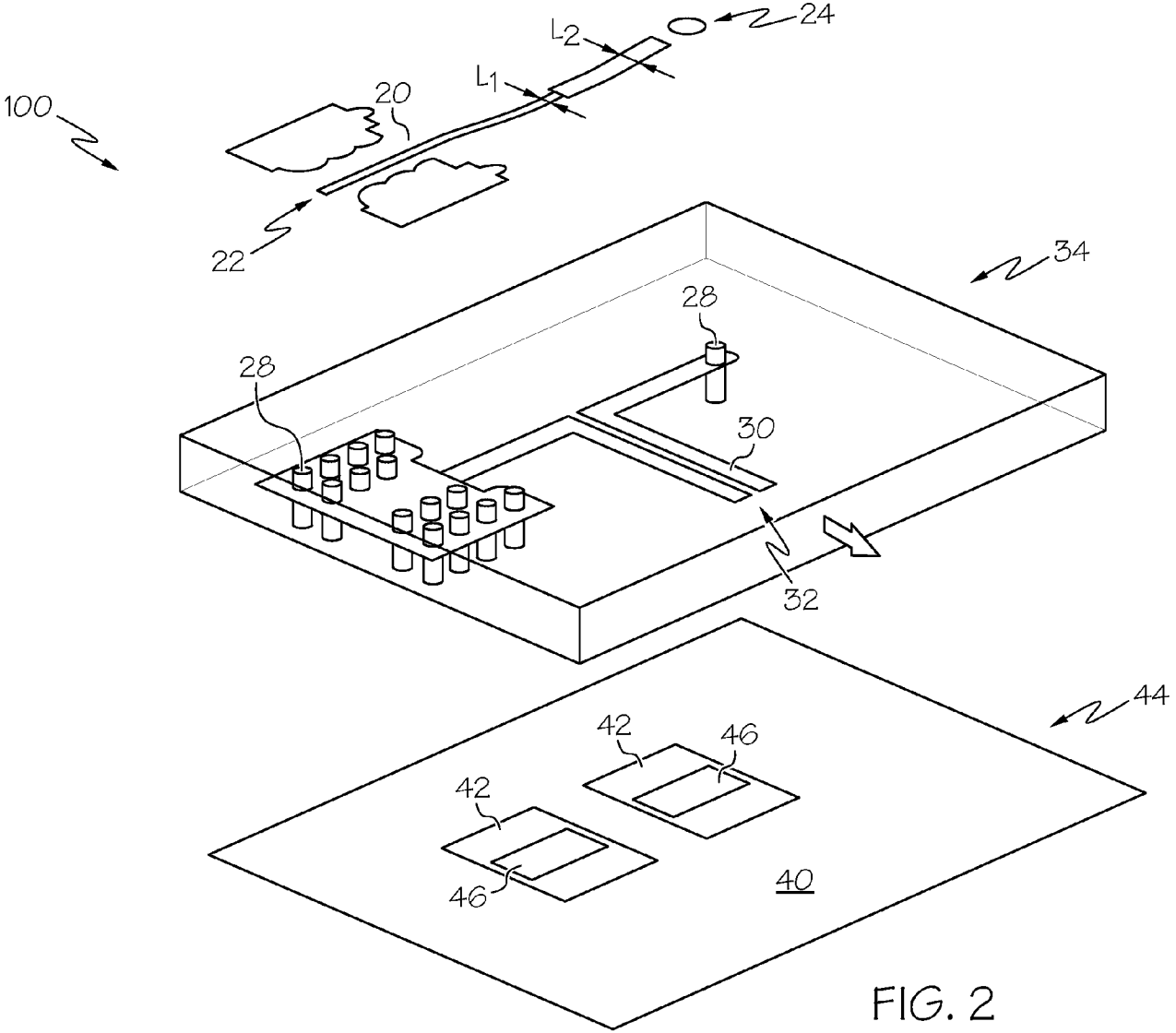
FIG. 2 shows an assembly view of a Marchand balun structure according to embodiments of the invention.

Turning now to FIG. 2, an exploded assembly view of a Marchand balun structure 100 according to embodiments of the invention is shown. The Marchand balun structure 100 includes a first trace 20 for an unbalanced port 22 and a pair of traces 30 for balanced ports 22. That is, the Marchand balun structure 100 may take an unbalanced, single-ended signal via the unbalanced port 22 and convert the signal to a balanced, differential signal via the balanced ports 32.

The first trace 20 is on a first metal layer 24, while the pair of traces 30 are on a second metal layer 34. Between the first metal layer 24 and the second metal layer 34 may be any known dielectric material. On a third metal layer 44 is a ground plane 40. A plurality of grounding vias 28 provide ground connection for shapes on the metal layers 24, 34 to the grounding plane 40.

The first trace 20 includes an unbalanced line that includes a first width $L_1$ for a first portion and a second width $L_2$ for a second portion. As seen clearly in FIG. 2, second width $L_2$ is different from first width $L_1$. In an embodiment, $L_1$ is about 7 mils and $L_2$ is about 19 mils. The pair of traces 30 includes a pair of balanced lines that feed to the balanced ports 32. Further, the ground plane 40 includes a pair of openings 42. Each opening 42 includes a floating ground pad 46. Once assembled, the pair of openings 42 in the ground plane 40 are directly under the pair of traces 30 for the balanced ports 32.

Figure 3:
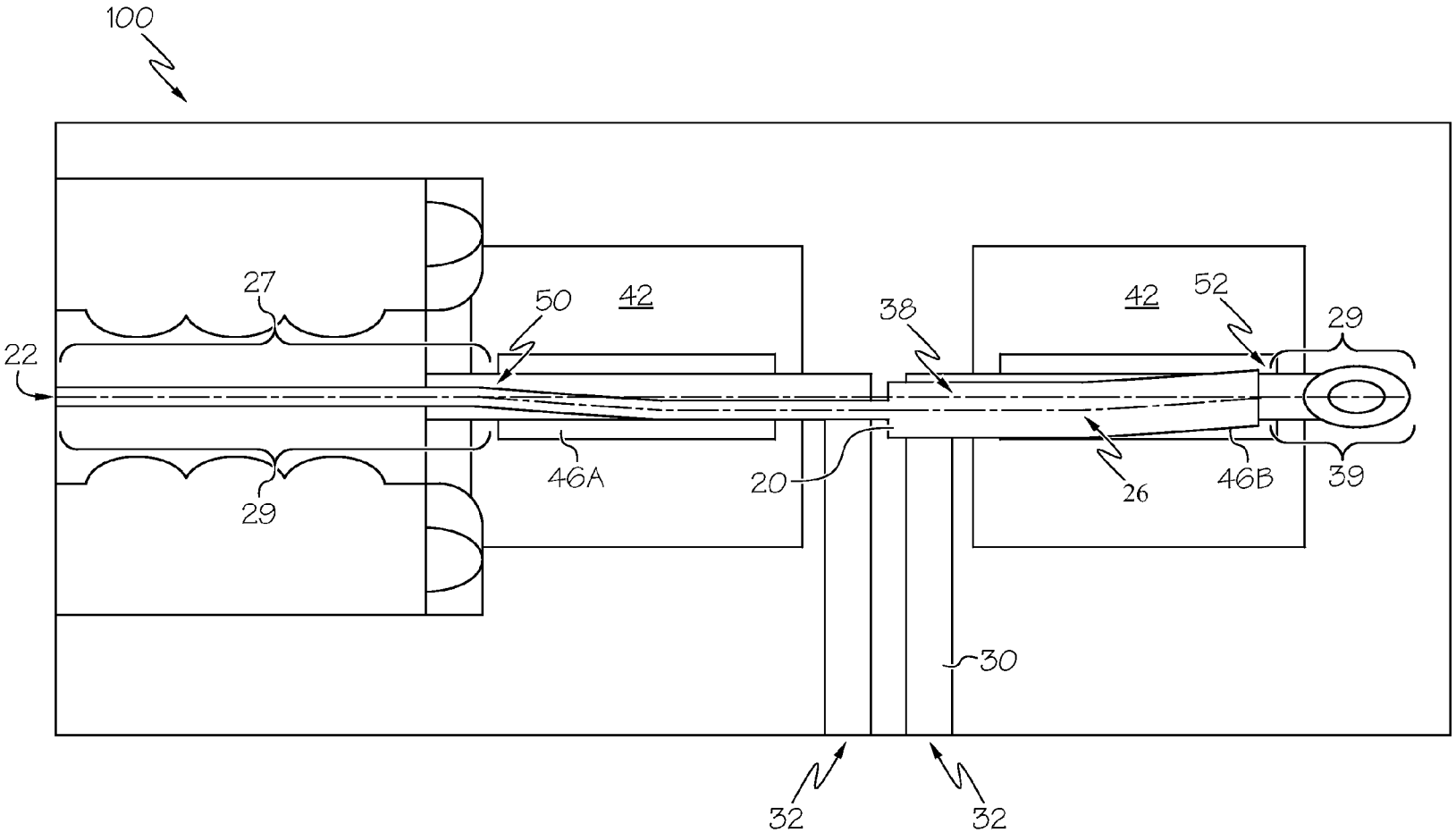
FIG. 3 shows a top view of a Marchand balun structure according to embodiments of the invention.

Turning now to FIG. 3, a top view of an assembled Marchand balun structure 100 according to embodiments of the invention is shown. As clearly seen in FIG. 3, a center line 26 for the unbalanced line of the first trace 20 is offset from a center line 38 for the pair of balanced lines of the pair of traces 30. The center lines 26, 38 are offset in a center portion of each line 26, 38. That is, the offset begins at a point 50 above the first floating ground pad 46A. A first portion 27 of the unbalanced line of the first trace 20 is not offset from a first portion 37 of the balanced lines of the pair of traces 30. Further, the offset ends at a point 52, i.e. the second end of the unbalance line 20, and above the end of the second floating ground pad 46B. The offset between center lines 26, 38, plus the ground opening, floating ground pads, and different widths of first trace 20, improve and increase the bandwidth of Marchand balun structure 100 to greater than 100%. The offset between lines 26 and 38 compensates the asymmetry of the structure 100 at the right angles of the balanced lines 30. The bandwidth also is optimized by ending the offset between lines 26 and 38 at points 50 and 52 where balanced lines 30 provide ground conditions to the unbalanced line 20 above them.

Figure 4:
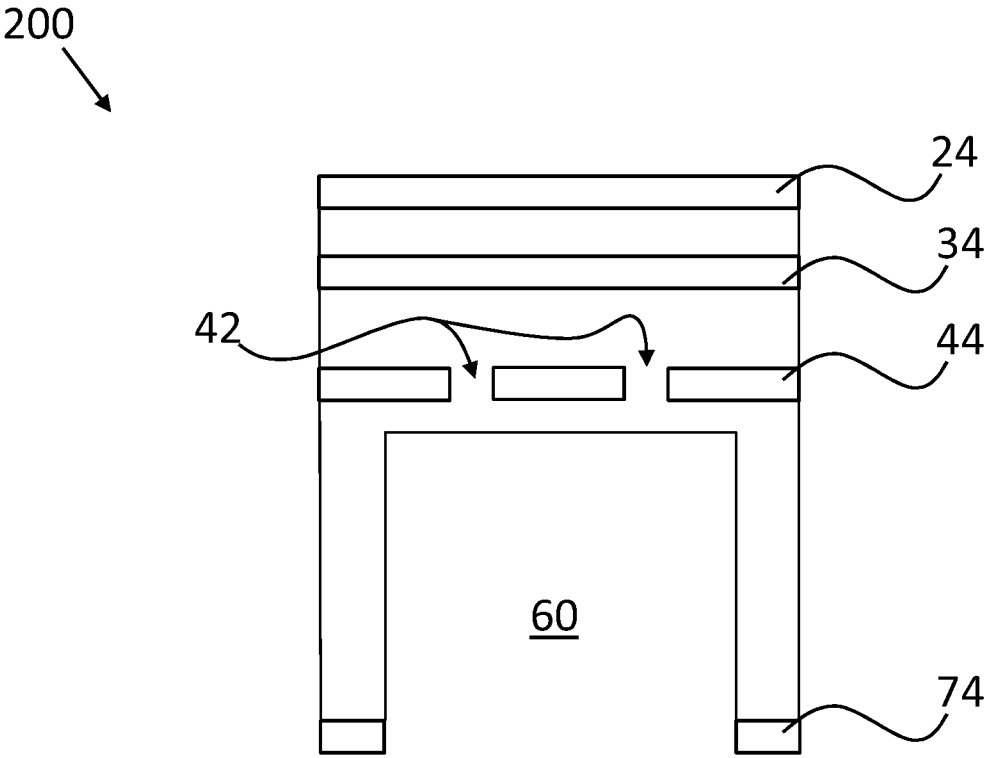
FIG. 4 shows a cross-sectional view of a Marchand balun structure according to embodiments of the invention.

Turning now to FIG. 4, a cross-sectional view of a Marchand balun structure 200 according to embodiments of the invention is shown. The Marchand balun structure 200 shown in FIG. 4 is substantially similar to the Marchand balun structure 100 shown in FIGS. 2-3. However, for a thick printed circuit board (PCB) process (i.e., greater than three metal layers), in order to increase the bandwidth of the Marchand balun structure 200, an air-filled cavity 60 can be made using back drilling under the balun structure 200 and below the third metal layer 44 that includes the grounding plane 40. For example, the cavity 60 may be through a twelfth metal layer 74 (fourth through eleventh metal layers not shown for clarity purposes, only). The cavity 60 is directly below the traces (not shown) that are in first metal layer 24 and second metal layer 34, and the openings 42 of grounding plane 40. The bandwidth of conventional baluns is limited by the ratio of even-mode to odd-mode impedance, which can be increased by using the openings and the floating pads in the ground plane. The cavity 60 lowers the equivalent dielectric constant of the substrate between the balanced lines 30 and the ground 40. Because the unbalanced line is on the top layer and the balanced line in the middle is its ground, even-mode impedance decreases more than the odd-mode impedance when the cavity is used.

Figure 5:
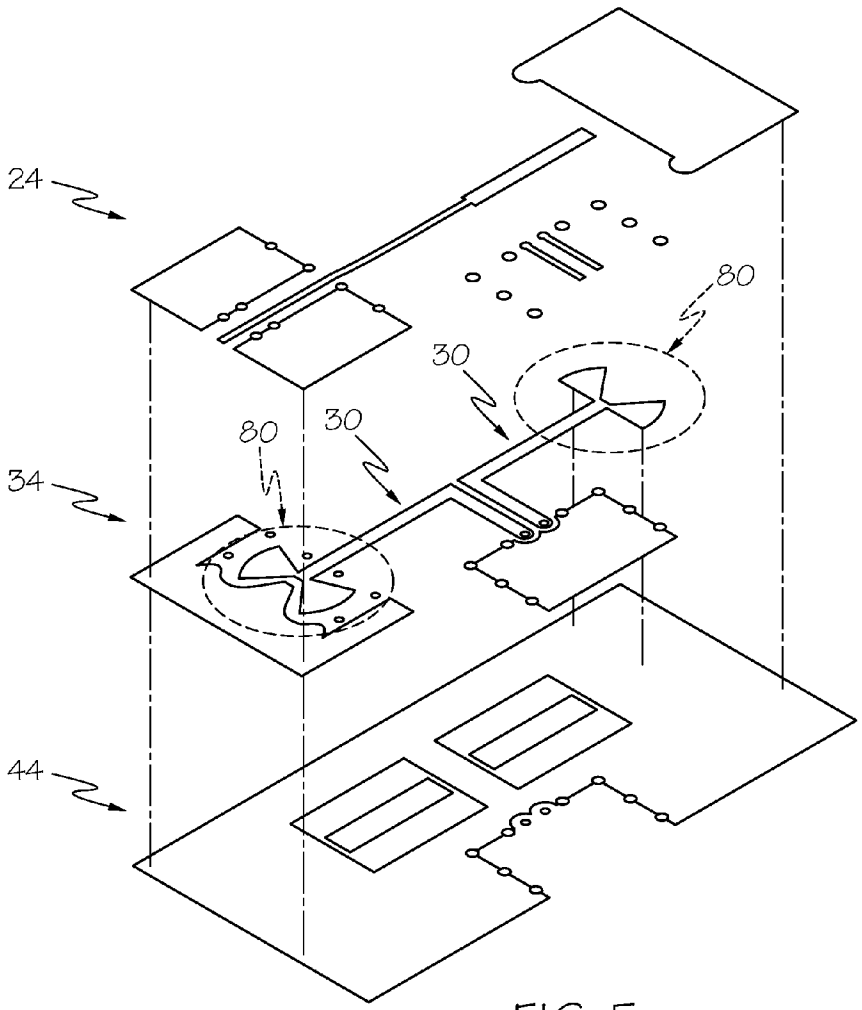
FIG. 5 shows an assembly view of a Marchand balun structure according to embodiments of the invention.
Figure 6:
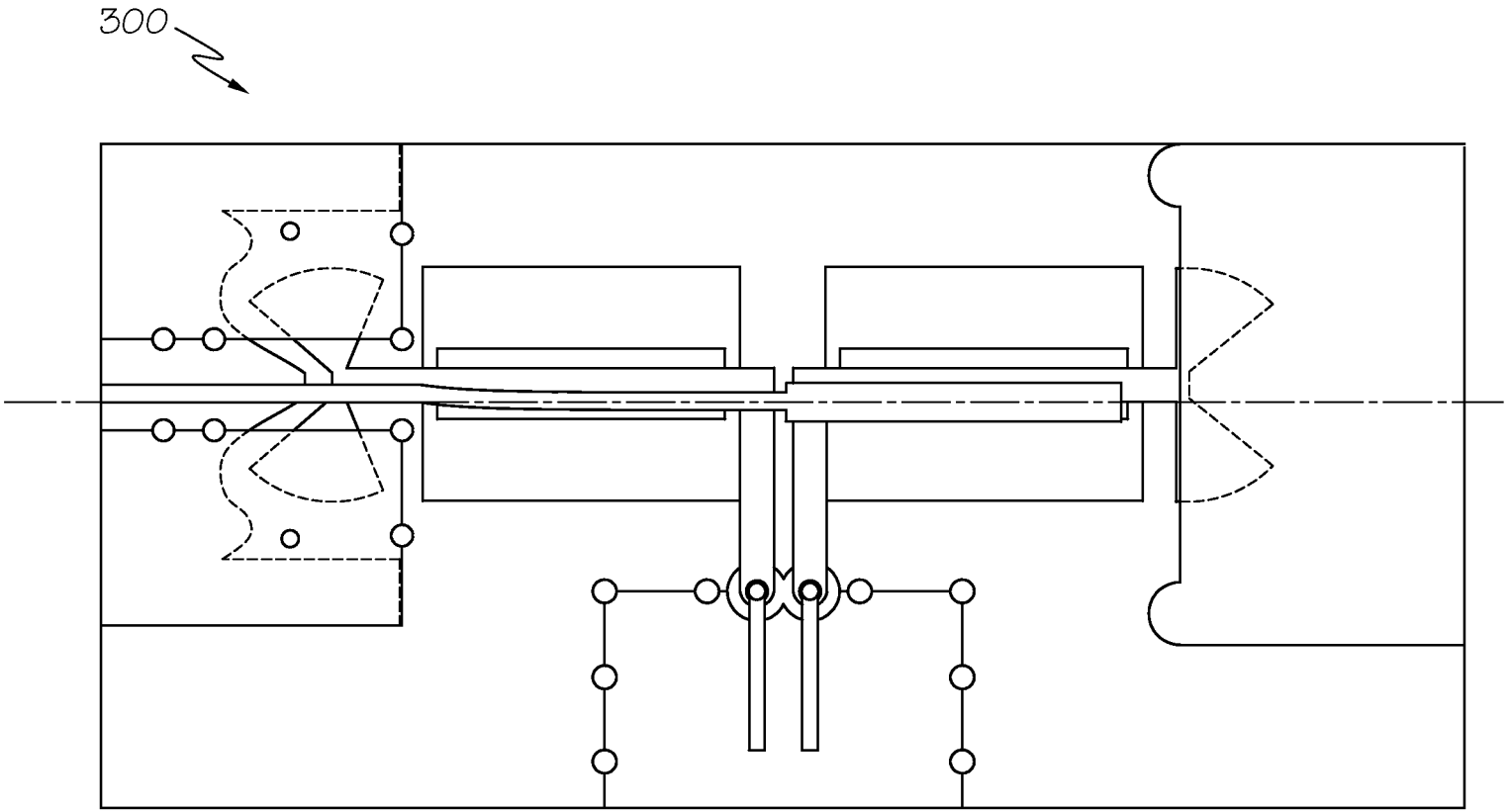
FIG. 6 shows a top view of a Marchand balun structure according to embodiments of the invention.

Turning now to FIG. 5, an assembly view of the first, second, and third metal layers 24, 34, 44 for a Marchand balun structure 300 according to embodiments of the invention is shown. FIG. 6 shows a top view of an assembled Marchand balun structure 300 according to embodiments of the invention.

The Marchand balun structure 300 shown in FIG. 5 is similar to the Marchand balun structure 100 shown in FIGS. 2-3. However, in the second metal layer 34, the ends of each balanced trace 30 includes a "butterfly" radio frequency (RF) stub 80 to provide for an RF ground. These butterfly RF stubs 80 are configured such that the balanced traces 30 are AC grounded (as opposed to DC grounded in the Marchand balun structure 100 shown in FIGS. 2-3). This embodiment keeps DC an open-circuit for the balanced traces 30 so that a DC bias or a DC voltage sense can be added directly without adding another structure (i.e., a bias T) or components (i.e., a DC block), while maintaining the broad bandwidth of the Marchand balun structure 300.

Figure 7:
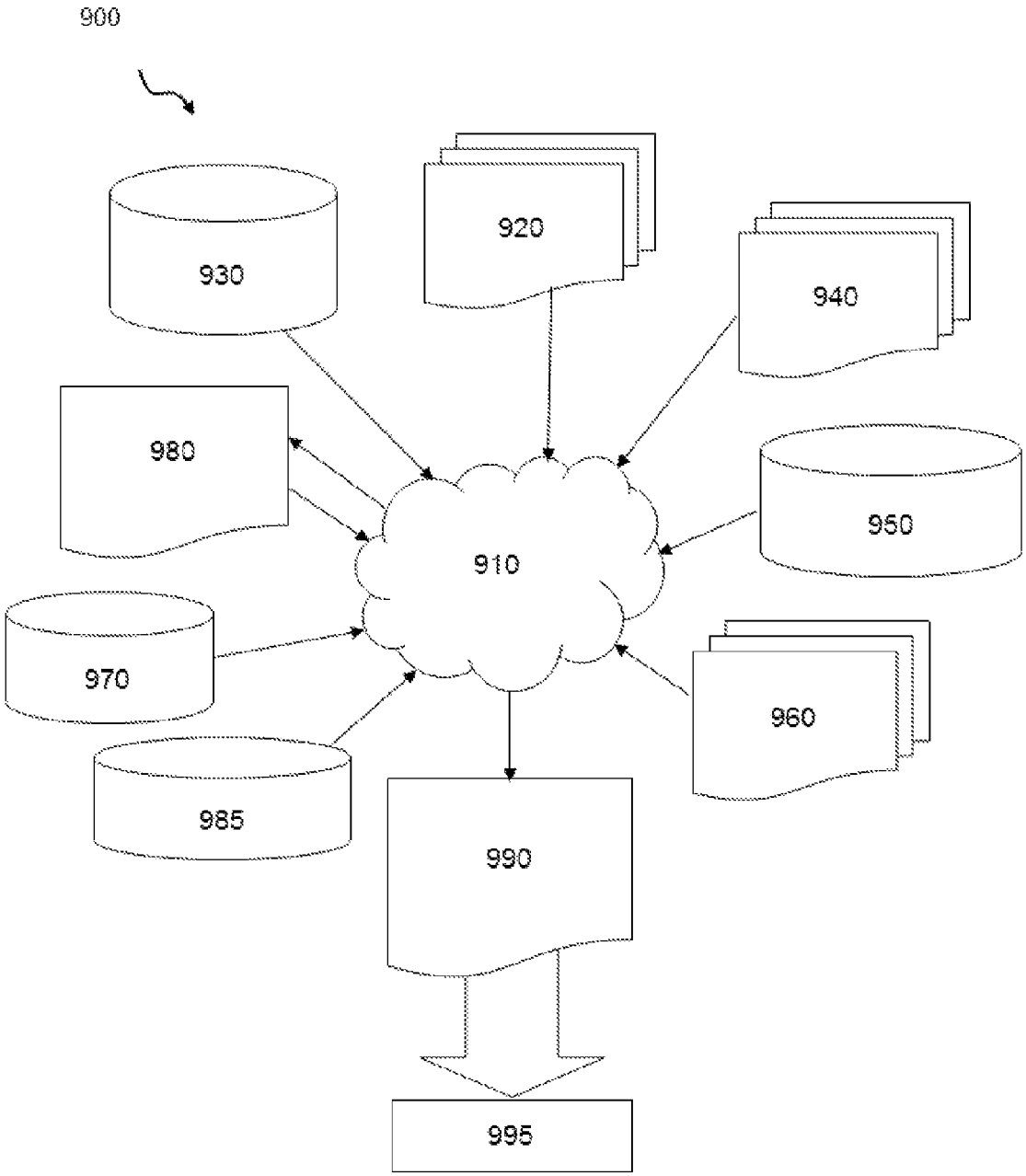
FIG. 7 is a flow diagram of a design process used in semiconductor design, manufacture, and/or test according to embodiments of the invention.

FIG. 7 shows a block diagram of an exemplary design flow 900 used for example, in semiconductor IC logic design, simulation, test, layout, and manufacture. Design flow 900 includes processes, machines and/or mechanisms for processing design structures or devices to generate logically or otherwise functionally equivalent representations of the design structures and/or devices described above and shown in FIGS. 2-6. The design structures processed and/or generated by design flow 900 may be encoded on machine-readable transmission or storage media to include data and/or instructions that when executed or otherwise processed on a data processing system generate a logically, structurally, mechanically, or otherwise functionally equivalent representation of hardware components, circuits, devices, or systems. Machines include, but are not limited to, any machine used in an IC design process, such as designing, manufacturing, or simulating a circuit, component, device, or system. For example, machines may include: lithography machines, machines and/or equipment for generating masks (e.g. e-beam writers), computers or equipment for simulating design structures, any apparatus used in the manufacturing or test process, or any machines for programming functionally equivalent representations of the design structures into any medium (e.g. a machine for programming a programmable gate array).

Design flow 900 may vary depending on the type of representation being designed. For example, a design flow 900 for building an application specific IC (ASIC) may differ from a design flow 900 for designing a standard component or from a design flow 900 for instantiating the design into a programmable array, for example a programmable gate array (PGA) or a field programmable gate array (FPGA) offered by Altera® Inc. or Xilinx® Inc.

FIG. 7 illustrates multiple such design structures including an input design structure 920 that is preferably processed by a design process 910. Design structure 920 may be a logical simulation design structure generated and processed by design process 910 to produce a logically equivalent functional representation of a hardware device. Design structure 920 may also or alternatively comprise data and/or program instructions that when processed by design process 910, generate a functional representation of the physical structure of a hardware device. Whether representing functional and/or structural design features, design structure 920 may be generated using electronic computer-aided design (ECAD) such as implemented by a core developer/designer. When encoded on a machine-readable data transmission, gate array, or storage medium, design structure 920 may be accessed and processed by one or more hardware and/or software modules within design process 910 to simulate or otherwise functionally represent an electronic component, circuit, electronic or logic module, apparatus, device, or system such as those shown in FIGS. 2-6. As such, design structure 920 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 910 preferably employs and incorporates hardware and/or software modules for synthesizing, translating, or otherwise processing a design/simulation functional equivalent of the components, circuits, devices, or logic structures shown in FIGS. 2-6 to generate a netlist 980 which may contain design structures such as design structure 920. Netlist 980 may comprise, for example, compiled or otherwise processed data structures representing a list of wires, discrete components, logic gates, control circuits, I/O devices, models, etc. that describes the connections to other elements and circuits in an integrated circuit design. Netlist 980 may be synthesized using an iterative process in which netlist 980 is resynthesized one or more times depending on design specifications and parameters for the device. As with other design structure types described herein, netlist 980 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 910 may include hardware and software modules for processing a variety of input data structure types including netlist 980. Such data structure types may reside, for example, within library elements 930 and include a set of commonly used elements, circuits, and devices, including models, layouts, and symbolic representations, for a given manufacturing technology (e.g., different technology nodes, 32 nm, 45 nm, 90 nm, etc.). The data structure types may further include design specifications 940, characterization data 950, verification data 960, design rules 970, and test data files 985 which may include input test patterns, output test results, and other testing information. Design process 910 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 910 without deviating from the scope and spirit of the invention. Design process 910 may also include modules for performing standard circuit design processes such as timing analysis, verification, design rule checking, place and route operations, etc.

Design process 910 employs and incorporates logic and physical design tools such as HDL compilers and simulation model build tools to process design structure 920 together with some or all of the depicted supporting data structures along with any additional mechanical design or data (if applicable), to generate a second design structure 990. Design structure 990 resides on a storage medium or programmable gate array in a data format used for the exchange of data of mechanical devices and structures (e.g. information stored in an IGES, DXF, Parasolid XT, JT, DRG, or any other suitable format for storing or rendering such mechanical design structures). Similar to design structure 920, design structure 990 preferably comprises one or more files, data structures, or other computer-encoded data or instructions that reside on transmission or data storage media and that when processed by an ECAD system generate a logically or otherwise functionally equivalent form of one or more of the embodiments of the invention shown in FIG. 3. In one embodiment, design structure 990 may comprise a compiled, executable HDL simulation model that functionally simulates the devices shown in FIGS. 2-6.

Design structure 990 may also employ a data format used for the exchange of layout data of integrated circuits and/or symbolic data format (e.g. information stored in a GDSII (GDS2), GL1, OASIS, map files, or any other suitable format for storing such design data structures). Design structure 990 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 2-6. Design structure 990 may then proceed to a stage 995 where, for example, design structure 990: proceeds to tape-out, is released to manufacturing, is released to a mask house, is sent to another design house, is sent back to the customer, etc.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A Marchand balun structure comprising:

a first trace for an unbalanced port on a first metal layer, the first trace comprising:

an unbalanced line including a first width for a first half and a second width for a second half, wherein the second width is different from the first width;

a pair of traces for balanced ports on a second metal layer, the pair of traces comprising:

a pair of balanced lines; and a ground plane on a third metal layer, the ground plane comprising:

a pair of openings directly under the pair of traces for balanced ports, wherein a center of the unbalanced line of the first trace is offset from a center of the pair of balanced lines of the pair of traces.

2. The Marchand balun structure of claim 1, further comprising a floating ground pad in each opening in the ground plane.

3. The Marchand balun structure of claim 2, wherein the offset begins at a point above a first floating ground pad and the offset ends at a point above a second floating ground pad.

4. The Marchand balun structure of claim 1, wherein a first portion of the unbalanced line is not offset from a first portion of a first balanced line of the pair of traces.

5. The Marchand balun structure of claim 4, wherein a second portion of the unbalanced line is not offset from a first portion of a second balanced line of the pair of traces.

6. The Marchand balun structure of claim 1, further comprising a first dielectric layer between the first metal layer and the second metal layer.

7. The Marchand balun structure of claim 6, further comprising a second dielectric layer between the second metal layer and the third metal layer.

8. The Marchand balun structure of claim 1, further comprising a plurality of metal layers.

9. The Marchand balun structure of claim 8, further comprising a cavity within the metal layers under the third metal layer, wherein the cavity is directly below the balun structures.

10. The Marchand balun structure of claim 1, further comprising radio frequency (RF) stubs at one end of each balanced port trace for providing an RF ground.

11. A method of designing a Marchand balun structure, comprising:

providing a first trace for an unbalanced port on a first metal layer, the first trace comprising:

an unbalanced line including a first width for a first half and a second width for a second half, wherein the second width is different from the first width;

providing a pair of traces for balanced ports on a second metal layer, the pair of traces comprising:

a pair of balanced lines; and providing a grounding plane on a third metal layer, the ground plane comprising:

a pair of openings directly under the pair of traces for balanced ports, wherein a center of the unbalanced line of the first trace is offset from a center of the pair of balanced lines of the pair of traces.

12. The method of designing a Marchand balun structure of claim 11, further comprising providing a floating ground pad in each opening in the ground plane.

13. The method of designing a Marchand balun structure of claim 12, wherein the offset begins at a point above a first floating ground pad and the offset ends at a point above a second floating ground pad.

14. The method of designing a Marchand balun structure of claim 11, wherein a first portion of the unbalanced line is not offset from a first portion of a first balanced line of the pair of traces.

15. The method of designing a balun structure of claim 14, wherein a second portion of the unbalanced line is not offset from a first portion of a second balanced line of the pair of traces.

16. The method of designing a Marchand balun structure of claim 11, further comprising providing a first dielectric layer between the first metal layer and the second metal layer.

17. The method of designing a Marchand balun structure of claim 16, further comprising providing a second dielectric layer between the second metal layer and the third metal layer.

18. The method of designing a Marchand balun structure of claim 11, further comprising providing a plurality of metal layers below the ground plane.

19. The method of designing a Marchand balun structure of claim 18, further comprising a cavity within the metal layers under the third metal layer, wherein the cavity is directly below the balun structures.

20. The method of designing a Marchand balun structure of claim 11, further comprising providing radio frequency (RF) stubs at one end of each balanced port trace for providing an RF ground.

* * * * *